US010692712B2

(12) United States Patent
Welkie et al.

(10) Patent No.: US 10,692,712 B2
(45) Date of Patent: Jun. 23, 2020

(54) ION TRANSFER FROM ELECTRON IONIZATION SOURCES

(71) Applicant: PerkinElmer Health Sciences, Inc., Waltham, MA (US)

(72) Inventors: David G. Welkie, Trumbull, CT (US); Tong Chen, Shelton, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 15/940,431

(22) Filed: Mar. 29, 2018

(65) Prior Publication Data

US 2018/0286657 A1 Oct. 4, 2018

Related U.S. Application Data

(60) Provisional application No. 62/480,738, filed on Apr. 3, 2017.

(51) Int. Cl.

| | |
|---|---|
| ***H01J 49/40*** | (2006.01) |
| ***H01J 49/04*** | (2006.01) |
| ***H01J 49/14*** | (2006.01) |
| ***H01J 49/06*** | (2006.01) |

(52) U.S. Cl.

CPC ..... *H01J 49/147* (2013.01); *H01J 49/0422* (2013.01); *H01J 49/0468* (2013.01); *H01J 49/0481* (2013.01); *H01J 49/063* (2013.01); *H01J 49/40* (2013.01)

(58) Field of Classification Search

CPC .... H01J 49/063; H01J 49/005; H01J 49/0481; H01J 49/0054; H01J 49/066; H01J 49/4225

USPC ..... 250/288, 281, 283, 290, 292, 427

See application file for complete search history.

(56) References Cited

U.S. PATENT DOCUMENTS

| | | | | |
|---|---|---|---|---|
| 6,800,846 | B2 * | 10/2004 | Bateman | H01J 49/062 250/281 |
| 6,919,562 | B1 * | 7/2005 | Whitehouse | H01J 49/147 250/288 |
| 7,166,836 | B1 * | 1/2007 | Russ, IV | H01J 49/04 250/281 |
| 7,291,845 | B2 * | 11/2007 | Moeller | H01J 49/147 250/423 R |

(Continued)

OTHER PUBLICATIONS

International Search Report and Written Opinion dated Jun. 26, 2018, in corresponding Application No. PCT/US 18/25221, pp. 1-13.

*Primary Examiner* — David A Vanore
(74) *Attorney, Agent, or Firm* — Fish & Richardson P.C.

(57) ABSTRACT

An example system includes an electron ionization ion source and a mass analyzer. The electron ion source is configured, during operation of the system, to create from sample molecules a beam of ions extending along an ion beam axis. The system also includes a collision cooling chamber comprising a gas manifold and an electric field generator. The cooling chamber defines an entrance aperture and an exit aperture on respective opposing ends of the cooling chamber, the entrance aperture of the cooling chamber being in axial alignment with the ion beam axis. The cooling chamber is configured, during operation of the system, to generate a radio frequency (RF) field within the cooling chamber using the electric field generator, and receive collision gas through the gas manifold to pressurize the cooling chamber.

29 Claims, 9 Drawing Sheets

(56) References Cited

U.S. PATENT DOCUMENTS

| | | | | |
|---|---|---|---|---|
| 7,838,826 | B1 * | 11/2010 | Park | G01N 27/622 250/281 |
| 8,389,929 | B2 * | 3/2013 | Schoen | H01J 49/26 250/281 |
| 9,012,837 | B2 * | 4/2015 | Kou | H01J 49/0036 250/282 |
| 9,373,493 | B2 * | 6/2016 | Kou | H01J 49/427 |
| 2004/0238755 | A1 * | 12/2004 | Lee | H01J 49/063 250/423 R |
| 2008/0203286 | A1 * | 8/2008 | Loboda | H01J 49/0481 250/281 |
| 2011/0186732 | A1 | 8/2011 | Yasuno | |
| 2012/0292498 | A1 * | 11/2012 | Jiang | H01J 49/004 250/282 |
| 2013/0193318 | A1 * | 8/2013 | Land | H01J 49/10 250/282 |
| 2015/0097114 | A1 * | 4/2015 | Green | H01J 49/0059 250/282 |
| 2015/0170898 | A1 * | 6/2015 | Jiang | H01J 49/063 250/282 |
| 2015/0364309 | A1 * | 12/2015 | Welkie | H01J 49/062 250/282 |
| 2015/0371839 | A1 | 12/2015 | Yasuno | |

* cited by examiner

ION TRANSFER FROM ELECTRON IONIZATION SOURCES

TECHNICAL FIELD

This disclosure relates to mass spectroscopy systems, and more particularly to transferring ions from an ion source to a mass analyzer.

BACKGROUND

Gas chromatography/mass spectrometry (GC/MS) is an analytical method that combines the features of gas-chromatography and mass spectrometry to identify different substances within a test sample.

In some GC/MS instruments, ions are produced by electron ionization (EI) in an EI source, and then transferred to a downstream mass analyzer (e.g., a quadrupole mass filter) for examination. In some cases, direct current (DC) electrode lenses can be used to focus ions into a downstream vacuum stage and into the entrance of the mass analyzer to improve the collection of ions.

SUMMARY

This disclosure features systems and techniques for efficiently transferring ions from an ion source (e.g., an electron ionization (EI) ion source) to a downstream mass analyzer entrance in the context of a mass spectrometry instrument.

In GC/MS instruments, a sample is separated into by a gas chromatograph (e.g., using a capillary column that separates sample constituents based on their relative retention within the column). Sample constituents eluted from the column are ionized, and the ionized sample constituents are analyzed by a mass spectrometer.

Ions can be produced by in ion sources (e.g., an electron ionization (EI) ion source, a chemical ionization (CI) ion source, etc.), and then transferred to a downstream mass analyzer (e.g., a quadrupole mass filter).

In some cases, direct current (DC) electrode lenses can be used to deliver ions exiting the ion source to the entrance of the mass analyzer (e.g., by focusing ions into a downstream vacuum stage and into the entrance of the mass analyzer). In general, the transmission of the mass analyzer improves with finer focus and/or lower angular spread of the ions at the entrance. However, the ability of DC lenses to deliver good ion beam focal characteristics is often limited by the angular and kinetic energy spread of the ions exiting the ions source, by aberration characteristics inherent in such electrostatic lenses, and by scattering of ions due to collisions with background gas molecules in the region between the ions source and mass analyzer entrance. These limitations, in turn, may limit how well the ions are focused at the mass analyzer entrance, and consequently, limit analytical performance.

As an example, in some cases, ions are produced with a broad initial spatial distribution inside the ion source, and exit the ion source with a broad distribution of ion kinetic energy and extraction angles. This distribution can limit the capability of DC lenses to deliver good ion beam focal characteristics. In some cases, the phase-space distribution of ions delivered to the entrance of mass analyzer can be broad enough to compromise the analytical performances of mass analyzer (e.g., sensitivity and mass resolution, etc.).

Accordingly, in some implementations, rather than employing DC electrostatic lenses to transfer ions from the ion source to the mass analyzer entrance, the disclosed systems can incorporate one or more RF-only ion guides to transfer ions directly from the ion source exit to the mass analyzer entrance.

In one aspect, the relatively high background gas pressure in the ion source vacuum stage results in collision cooling of the ions, which facilitates reduction in the widths of the ions' kinetic energy distribution, radial position distribution, and radial velocity distribution, at the mass analyzer entrance, thereby improving mass analyzer performance.

In another aspect, extraction and efficient transfer of ions having a substantially larger distribution of kinetic energies and spatial and extraction angles are enabled, owing to the aforementioned subsequent reduction of these distributions by collision cooling. Hence, an electron impact ion source can be configured such that sample molecules are ionized, extracted, and effectively and efficiently transferred from a much larger ionization volume, resulting in improved sensitivity.

In yet another aspect, an electric field contour within the ionization volume is established, such that ions of an even greater spatial distribution in ionization volume can be extracted to the RF ion guide entrance.

In yet another aspect, an axial field is imposed on the RF ion guide(s) between the ion source exit and the mass analyzer entrance, so that collision cooling does not result in delay of ion transport from the ion source to the mass analyzer entrance.

Further, the vacuum stage partition between the ion source region and the mass analyzer region may incorporate an RF aperture. Such an aperture can maintain the narrow radial position and velocity distributions better than a conventional inter-stage aperture having a DC voltage.

In another aspect, an apparatus can include (1) a pressurized chamber where collisions between ions and neutral gas molecules are induced, (2) one or more RF-only ion guides that generate a radial pseudo-potential well along the axis of cooling chamber, (3) a gas flow guide that provides a gas flow inside the cooling chamber with an inward radial flow field component and an axial flow field component pointing toward the exit of cooling chamber, (4) an auxiliary electrode assembly that provides an axial electric field extending along at least a portion of the length of the cooling chamber, and (5) entrance and exit electrodes positioned at the entrance and exit ends of the cooling chamber respectively.

During operation, ions can be extracted into the cooling chamber by the electrode assembly at the chamber entrance. The gas flow can help ions converge on the axis and move toward the downstream RF-only ion guide(s). When travelling through the ion guide(s), ions experience a radial pseudo-potential well and collisions with neutral gas molecules which further reduce ion kinetic energy and spatial distribution in radial dimension. Meanwhile, the axial electric field generated by the auxiliary electrode assembly can maintain the axial kinetic energy of ions moving toward the chamber exit. At the exit of the chamber, ions are expelled out by the electrode assembly, and delivered to the entrance of mass analyzer. In some cases, the electrode assembly positioned at the exit can incorporate an RF electric field to maintain the radial compactness of ion beam.

One or more of the implementations described herein can improve the performance of a mass analyzer (e.g., relative to the performance of a mass analyzer using conventional DC electrostatic lenses arrangements).

In an aspect, a system includes an ion source and a mass analyzer. The ion source includes an electron source configured, during operation of the system, to generate a flow of electrons; a sample introduction assembly configured, during operation of the system, to transport at least one analyte; an ionization chamber having a first input port, a second input port, and an outlet port. The first input port is configured, during operation of the system, to receive the flow of electrons from the electron source. The second input port is configured, during operation of the system, to receive the at least one analyte from the sample introduction assembly, whereby analyte ions are created by interaction between the at least one analyte and the electrons within an ionization region of the ionization chamber, and whereby the analyte ions exit the ionization chamber through the outlet ports along an ion beam axis. The ionization chamber includes at least two chamber electrodes configured, during operation of the system, to have respective independently controlled voltages applied thereto. The at least two chamber electrodes include an exit electrode defining the outlet port. The exit electrode is configured, during operation of the system, to have an exit electrode voltage applied thereto. The exit electrode includes an upstream surface facing the ionization region, the upstream surface defining a substantially frusto-conical shape having a smaller base and a larger base, the smaller base being proximal to or coincident with the outlet port. During operation of the system, electric fields within the ionization chamber resulting from the voltages applied to the exit electrode and at least one other of electrode act to focus and accelerate analyte ions from the ionization region through the outlet port.

Implementations of this aspect any include one or more of the following features.

In some implementations, the substantially frusto-conical shape can be formed by at least two disks butted face to face. The at least two disks can have apertures that are concentric with respect to the ion beam axis, wherein the sizes of the apertures monotonically decrease, respectively, from the disk closest to the ionization region to the disk farthest from the ionization region.

In some implementations, the electron beam generator can be configured, during operation of the system, to generate the electron beam in a first transverse direction within the ion source chamber, the first transverse direction being orthogonal to the ion beam axis. The ion source chamber can include a magnetic field generator configured, during operation of the system, to generate a magnetic field in a direction parallel to a direction of the electron beam and coincident with the electron beam.

In some implementations, the magnetic field generator can include at least two permanent magnets.

In some implementations, the at least two permanent magnets can be aligned in the direction parallel to the direction of the electron beam.

In some implementations, the at least two chamber electrodes can be configured to generate an electric field to spatially focus the sample ions through said ion exit outlet port.

In some implementations, the mass analyzer can include at least one of a quadrupole mass filter; a combination of two quadrupole mass filters separated by a collision chamber; a combination of a quadrupole mass filter, a collision chamber, and a time-of-flight mass analyzer; a time-of-flight mass analyzer; a three-dimensional ion trap; or a two-dimensional ion trap.

In some implementations, the sample introduction assembly can include an exit portion of a gas chromatography column.

In general, in another aspect, a system includes an electron ionization ion source and a mass analyzer. The electron ion source is configured, during operation of the system, to create from sample molecules a beam of ions extending along an ion beam axis. The system also includes a collision cooling chamber comprising a gas manifold and an electric field generator. The cooling chamber defines an entrance aperture and an exit aperture on respective opposing ends of the cooling chamber, the entrance aperture of the cooling chamber being in axial alignment with the ion beam axis. The cooling chamber is configured, during operation of the system, to generate a radio frequency (RF) field within the cooling chamber using the electric field generator, and receive collision gas through the gas manifold to pressurize the cooling chamber.

Implementations of this aspect any include one or more of the following features.

In some implementations, the electric field generator can be further configured, during operation of the system, to generate an axial electric field extending along at least a portion of a length of the cooling chamber.

In some implementations, the cooling chamber can be configured, during operation of the system, to be pressurized with collision gas at a pressure between 1 mTorr and 100 mTorr.

In some implementations, the cooling chamber can be configured, during operation of the system, to receive ions from the ion source chamber through the second entrance aperture, reduce a kinetic energy of at least some of the received ions, and expel at least some of the received ions out of the cooling chamber through the second exit chamber.

In some implementations, reducing a kinetic energy of at least some of the received ions can include inducing one or more collisions between the received ions and molecules of the cooling gas.

In some implementations, the electric field generator can include a plurality of conductive rods extending along at least a portion of the length of the cooling chamber. The rods can be arranged axisymmetrically within the cooling chamber.

In some implementations, the cooling chamber exit aperture can include a plurality of exit aperture electrodes arranged axisymetrically about a cooling chamber exit axis. The plurality of exit aperture electrodes can be configured, during operation of the system, to have RF and DC offset voltages applied thereto.

In some implementations, the mass analyzer can be configured, during operation of the system, to receive ions from the cooling chamber for mass analysis.

In some implementations, the mass analyzer can include at least one of a quadrupole mass filter; a combination of two quadrupole mass filters separated by a collision chamber; a combination of a quadrupole mass filter, collision chamber, and a time-of-flight mass analyzer; a time-of-flight mass analyzer; a three-dimensional ion trap; or a two-dimensional ion trap.

In some implementations, the system can further include a gas chromatograph. The ion source chamber can be configured, during operation of the system, to receive sample effluent from the gas chromatograph.

In some implementations, the system can further include a control module communicatively coupled to at least one of the ion source, the cooling chamber, the mass analyzer, a mass analyzer detection system, the gas chromatograph, or a transfer device. The control module can be configured, during operation of the system, to regulate an operation of at least one of the ion source, the cooling chamber, the mass analyzer, the mass analyzer detection system, the gas chromatograph, or the transfer device.

In some implementations, regulating the operation of at least one of the ion source, the cooling chamber, the mass analyzer, the mass analyzer detection system, the gas chromatograph, or the transfer device can include regulating a transfer of sample particles from the gas chromatograph to the ion source chamber.

In some implementations, regulating the operation of at least one of the ion source, the cooling chamber, the mass analyzer, the mass analyzer detection system, the gas chromatograph, or the transfer device can include regulating the ionization of at least some of the sample particles by the ion source chamber.

In some implementations, regulating the operation of at least one of the ion source, the cooling chamber, the mass analyzer, the mass analyzer detection system, the gas chromatograph, or the transfer device can include regulating an electric potential of each of the one or more electrodes.

In some implementations, regulating the operation of at least one of the ion source, the cooling chamber, the mass analyzer, the mass analyzer detection system, the gas chromatograph, or the transfer device can include regulating the generation of the RF field within the cooling chamber by the electric field generator.

In some implementations, regulating the operation of at least one of the ion source, the cooling chamber, the mass analyzer, the mass analyzer detection system, the gas chromatograph, or the transfer device can include regulating a transfer of inert gas into the cooling chamber through the gas manifold.

In some implementations, regulating the operation of at least one of the ion source, the cooling chamber, the mass analyzer, the mass analyzer detection system, the gas chromatograph, or the transfer device can include regulating a filtering of the ionized sample particles.

In general, in another aspect, a system includes an ion source chamber. The ion source chamber includes a first input port, a second input port, a first exit port, and one or more chamber electrodes proximate to the first exit port. The ion source chamber is configured, during operation, to receive an analyte through the first entrance port, receive a flow of electrons through the second entrance port, generate analyte ions in an ionization region within the ion source chamber through an interaction between the analyte and the electrons, and focus and accelerate the analyte ions, using the one or more chamber electrodes, from the ion source chamber through the exit port along an ion beam axis. The one or more electrodes define an electrode aperture along the ion beam axis. The electrode aperture has a cross-section area that monotonically decreases in a direction from the ionization region to the first exit port along the ion beam axis.

Implementations of this aspect any include one or more of the following features.

In some implementations, the system can further include a cooling chamber. The cooling chamber can include gas manifold, an electric field generator, and third input port on a first end of the cooling chamber. The third input port can be in axial alignment with the ion beam axis. The cooling chamber can also include a second exit port on a second end of the cooling chamber. The cooling chamber can be configured, during operation of the system, to generate a radio frequency (RF) field within the cooling chamber using the electric field generator, and receive collision gas through the gas manifold to pressurize the cooling chamber.

In general, in another aspect, a system includes an ion source configured, during operation of the system, to turn the sample molecules into a plurality of ions and deliver ions out of the ionization volume through ion source exit outlet port. The system also includes a collision cooling chamber including a gas manifold, a gas flow guide, at least one RF-only ion guide, an axial field electrode assembly, an entrance electrode assembly and an exit electrode assembly. The system also includes a mass analyzer.

Implementations of this aspect any include one or more of the following features.

In some implementations, the ion source can include at least one of an Electron Impact (EI) ionization source, or a Chemical Ionization (CI) source.

In some implementations, the axial field electrode assembly can be configured, during operation of the system, to generate an axial electric field extending along at least a portion of the length of the cooling chamber.

In some implementations, the cooling chamber can be configured, during operation of the system, to be pressurized with collision gas via a gas manifold.

In some implementations, the gas flow guide can be positioned at the entrance of cooling chamber and can be configured, during operation of the system, to form a conical conduit concentric with the entrance aperture of cooling chamber. A gas flow through the conduit can concentrate ions radially and move the ions toward downstream. A gas flow rate and a gas temperature can be adjustable via a controller.

In some implementations, the RF-only ion guide(s) can include a plurality of conductive columnar electrodes extending along at least a portion of the length of the cooling chamber and being arranged axisymmetrically within the cooling chamber.

In some implementations, the entrance electrode assembly can be configured, during operation of the system, to collect and receive ions from ion source. The entrance electrode assembly can be integrated into the ion source as a part.

In some implementations, the exit electrode assembly can be configured, during operation of the system, to expel at least some of the ions out of the cooling chamber. The exit electrode assembly can be further azimuthally divided into at least four subunits having RF and DC offset voltages applied thereto.

In some implementations, the mass analyzer can be configured, during operation of the system, to receive ions from the cooling chamber for mass analysis.

In some implementations, the mass analyzer can include at least one of a quadrupole mass filter; a combination of two quadrupole mass filters separated by a collision chamber; a combination of a quadrupole mass filter, collision chamber, and a time-of-flight mass analyzer; a time-of-flight mass analyzer; a three-dimensional ion trap; or a two-dimensional ion trap.

In some implementations, the system can further include a control module which is communicatively coupled to and regulates at least one of the ion sources, the cooling chamber, the gas flow controller, the gas manifold, the mass analyzer, a mass analyzer detection system, the gas chromatograph, or a transfer device.

The details of one or more embodiments are set forth in the accompanying drawings and the description below. Other features advantages will be apparent from the description and drawings, and from the claims.

DETAILED DESCRIPTION

Figure 1:
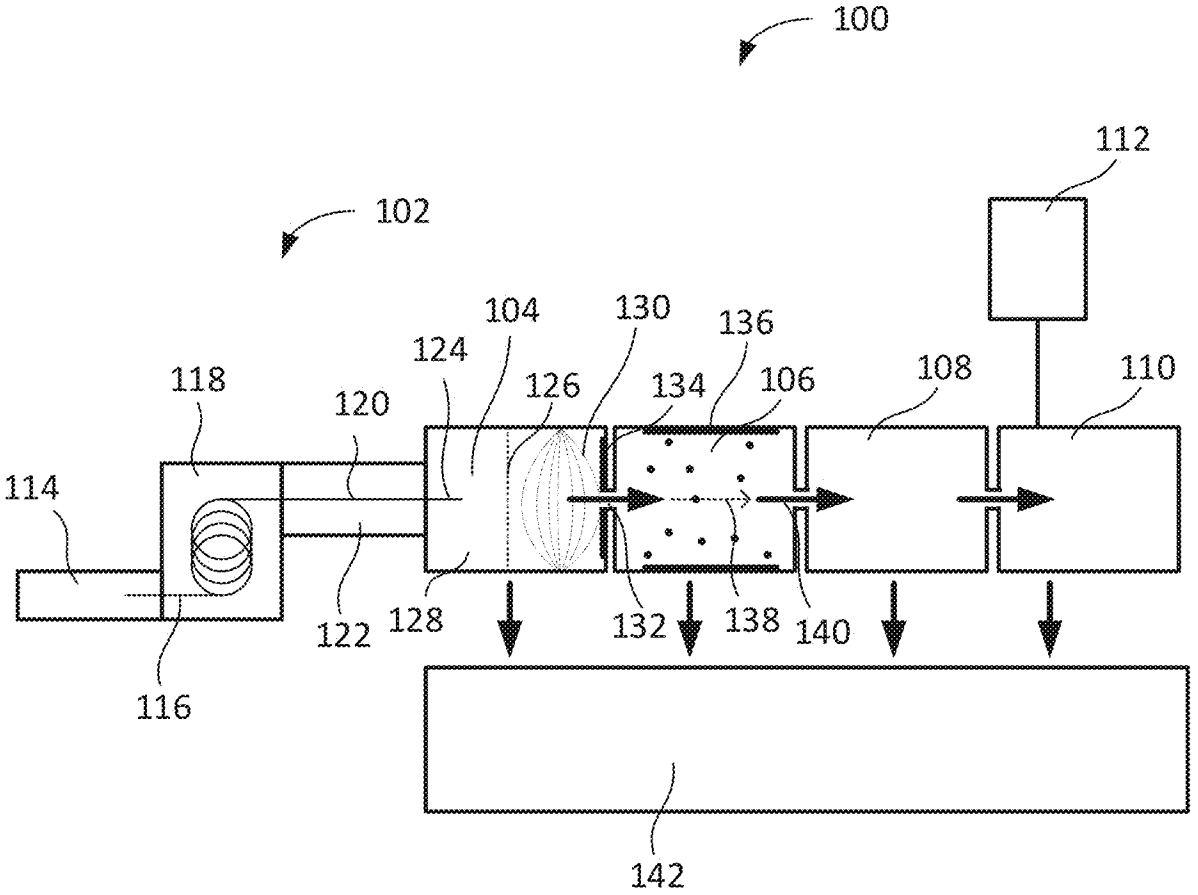
FIG. 1 is a schematic diagram of example gas chromatography/mass spectrometry (GC/MS) system.

A simplified schematic diagram of an example gas chromatography/mass spectrometry (GC/MS) system 100 is shown in FIG. 1. The system 100 includes a gas chromatograph 102, an ion source 104, an ion transfer chamber 106, a quadrupole mass filter 108, an ion detector 110, and a control module 112.

During operation of the system 100, samples are injected into an injector port 114 of the gas chromatograph 102, and enter into capillary column 116. The sample constituents flow through the column 116 and through a heated oven 118 with the help of a flow of helium gas. The sample constituents are separated according to their relative retention in the column 116. For example, the separation of sample constituents can depend on the column's dimensions (e.g., length, diameter, film thickness), as well as its phase properties. The difference in the chemical properties between different molecules in the sample and their relative affinity for the stationary phase of the column promote separation of the molecules as the sample travels the length of the column.

The exit portion 120 of the column 116 passes through a heated transfer component 122 such that an exit end 124 of the column 116 is located within the ion source 104. Having been separated in the column 116, the sample constituents elute sequentially from the exit end 124 into the ion source 104.

In some cases, the ion source 104 can be an electron ionization ion source. For example, as shown in FIG. 1, the ion source 104 can generate an electron beam 126 through an ion volume 128 of the ion source 104, causing a portion of the eluting constituents to be ionized by interaction with the electrons in the electron beam 126. Although an electron ionization ion source is shown in FIG. 1, other ion sources are also possible. For example, in some cases, the ion source 104 can be a chemical ionization ion source.

The ion source 104 also generates an electric field within the ion volume 128 (illustrated in the figure by equipotential contours 130) by applying voltage(s) to an extraction electrode 134, and/or a repeller electrode (not shown), and/or the ion volume housing. The sample ions formed within ion volume 128 respond to the electric field, and are accelerated out of the ion source 104 through an aperture 132 in the extraction electrode 134.

The sample ions are extracted through the extraction electrode aperture 132, and are transferred by an ion transfer chamber 106 to the entrance of the quadrupole mass filter 108.

The transmission efficiency and resolving power of the quadrupole mass filter 108 depends on the characteristics of the beam of sample ions entering the quadrupole mass filter 108 (e.g., the radial positions, angles, and to a lesser extent, kinetic energies, of the sample ions as they enter the quadrupole mass filter 108). These ion beam characteristics are, in turn, limited by the ionization efficiency and emission characteristics of the ion source, in conjunction with limitations of the focusing properties of any ion transfer optics (e.g., DC electrode lenses) used in the system.

To improve these characteristics, in some cases, the ion transfer chamber 106 can include an ion guide 136 that generates a radio frequency (RF) field in the ion transfer chamber 106. In some cases, the ion transfer chamber 106 can also generate an axial electric field (i.e., an electric field extending along the direction of the path of travel of the sample ion beam). The ion transfer chamber 106 can also be pressurized with a gas. Sample ions exiting the ion source are passed into the ion transfer chamber 106, and are constrained by the RF field to oscillate about an ion guide axis 138 as they traverse the length of the ion guide 136. Collisions with the gas molecules dissipate the sample ions' kinetic energy, resulting in a reduction of their radial excursion and kinetic energies, such that, upon reaching the exit end 140 of the ion transfer chamber 106, the sample ions can be focused into the entrance of the quadrupole mass filter 108 with improved beam characteristics (e.g., less variation in radial positions and angles, and with lower kinetic energy), allowing greater ion transmission and/or resolving power by the mass filter, than with conventional electrostatic optics. This can also be beneficial, for example, as it improves the transmission efficiency for initially broad spatial and angular ion distributions, such as produced from the ion source 104.

The focused ion beam at the exit 140 of the ion transfer chamber 106 is injected into the entrance of a quadrupole mass filter 108 for mass analysis of the sample ions. The quadrupole mass filter mass resolves the sample ions (e.g., based on their mass-to charge ratios (m/z)). As an example, the quadrupole mass filter 108 can include four parallel electrically conductive rods arranged in a 2×2 configuration, where each opposing rod pair is connected together electrically. A RF voltage with a DC offset voltage is applied between one pair of rods and the other. As sample ions travel down the quadrupole between the rods, only ions of a certain mass-to-charge ratio will reach the detector for a given ratio of voltages. Other ions have unstable trajectories and will collide with the rods. This permits selection of an ion with a particular m/z.

The mass-resolved ions exit through an exit end of the quadrupole mass filter 108, and are then detected by an ion detector 110. The output signal from the ion detector 110 is processed by the control module 112, where signal intensity of ions of the transmitted m/z are recorded.

The system 100 also includes a vacuum pumping system 142 that evacuates the various stages of the system 100. For example, the vacuum pumping system 142 can be in gaseous communication with the ion source 104, the ion transfer chamber 106, the quadrupole mass filter 108, and/or the ion detector 110, and can be configured to remove stray particles contained therein.

In addition to processing output signals from the ion detector, the control module 112 can also control the operation of some or all of the other components of the system 100. For example, in some cases, the control module 112 can be communicatively coupled to the ion source 104, the ion transfer chamber 106, the quadrupole mass filter 108, the ion detector 110, and/or the vacuum pumping system 142, and provide instructions or commands to regulate the performance of each component. In some cases, the control module 112 can be implemented, at least in part, using one or more computing devices (e.g., one or more electronic processing devices, each have one or more microprocessors, such as personal computers, smartphones, tablet computers, server computers, etc.).

Figure 2:
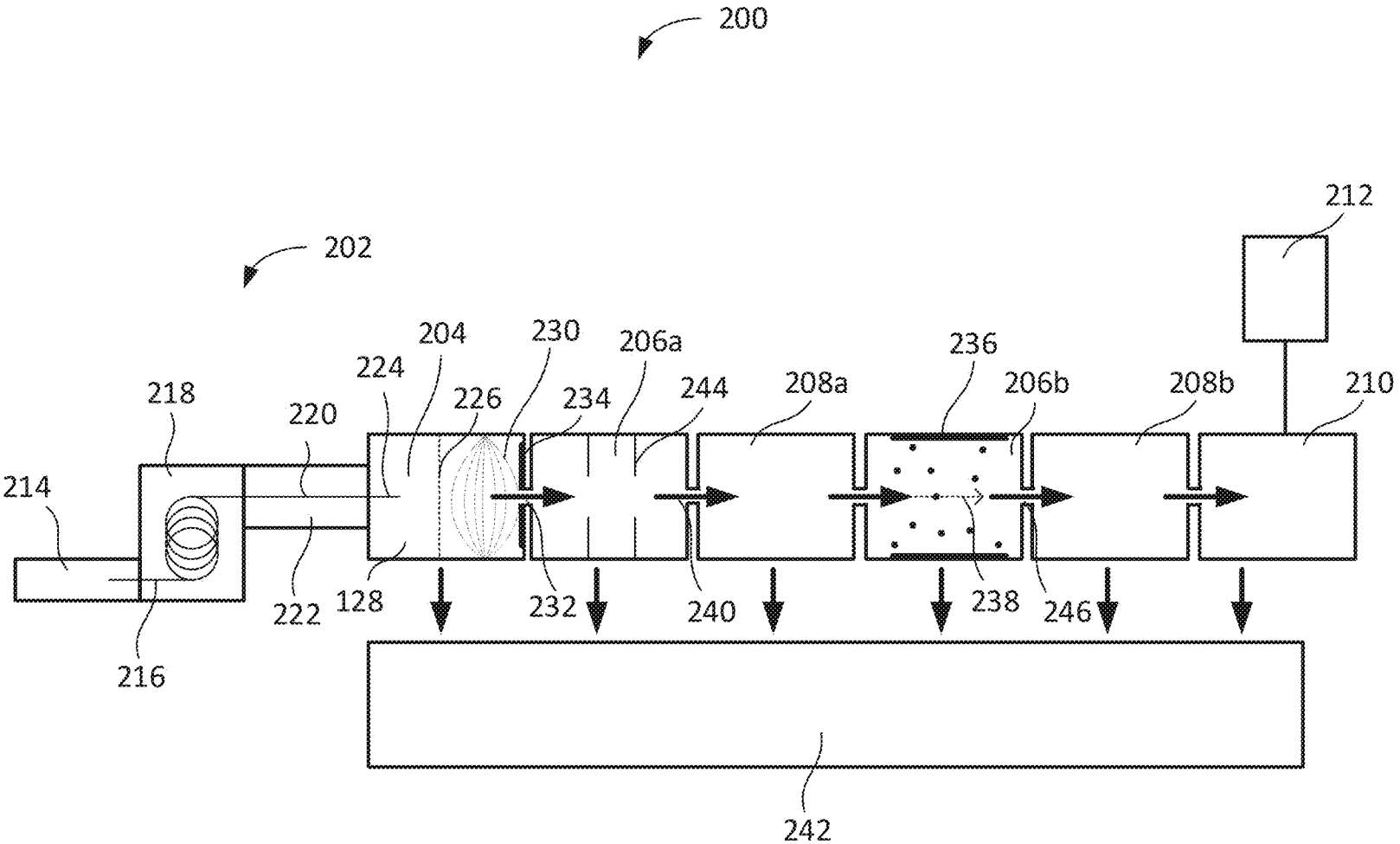
FIG. 2 is a schematic diagram of an example gas chromatography/mass spectrometry/mass-spectrometry (GC/MS/MS) system.

Although a single quadrupole configuration (i.e., GC/MS system) is shown in FIG. 1, this is merely an illustrative example. For example, the single quadrupole mass filter 108 shown in FIG. 1 can be replaced with any other mass spectrometer configuration, resulting in improved sensitivity and mass discrimination as described above for the single quadrupole mass filter configuration. In some cases, a system can have a multi-quadrupole configuration. As an example, FIG. 2 is a simplified schematic diagram of an example gas chromatography/mass spectrometry/mass-spectrometry (GC/MS/MS) system 200 (i.e., a double-quadrupole configuration). The system 200 includes a gas chromatograph 202, an ion source 204, two ion transfer chambers 206*a* and 206*b*, two quadrupole mass filters 208*a* and 208*b*, an ion detector 210, and a control module 212.

In general, the ion source 204 can function similarly as the ion source 104 shown in FIG. 1. For example, during operation of the system 200, samples are injected into an injector port 214 of the gas chromatograph 202, and enter into capillary column 216. The sample constituents flow through the column 216 and through a heated oven 218 with the help of a flow of helium gas. The sample constituents are separated according to their relative retention in the column 216.

Similarly, the exit portion 220 of the column 216 passes through a heated transfer component 222 such that an exit end 224 of the column 216 is located within the ion source 204. Having been separated in the column 216, the sample constituents elute sequentially from the exit end 224 into the ion source 204.

As above, in some cases, the ion source 204 can be an electron ionization ion source. For example, as shown in FIG. 2, the ion source 204 can generate an electron beam 226 through an ion volume 228 of the ion source 204, causing a portion of the eluting constituents to be ionized by interaction with the electrons in the electron beam 226.

Further, the ion source 204 also generates an electric field within the ion volume 228 (illustrated in the figure by equipotential contours 230) by applying voltage(s) to an extraction electrode 234, and/or a repeller electrode (not shown), and/or the ion volume housing. The sample ions formed within ion volume 228 respond to the electric field, and are accelerated out of the ion source 204 through an aperture 232 in the extraction electrode 234.

Similarly, the sample ions are extracted through the extraction electrode aperture 232, and are transferred by an ion transfer chamber 206*a* to the entrance of the quadrupole mass filter 208*a*. The ion transfer chamber 206*a* includes an ion guide 236*a* (e.g., an RF-only ion guide) and collision gas to focus ions from the extraction electrode aperture 232 to the quadrupole mass filter 208*a*, as similarly described above for the ion transfer chamber 106.

The focused ion beam at the exit 240 of the ion transfer chamber 206*a* is injected into the entrance of a quadrupole mass filter 208*a*, are resolved by mass. Mass-resolved ions selected by the quadrupole mass filter 208*a* (i.e., "precursor" ions) are accelerated into a second ion transfer chamber 206*b*.

The second ion transfer chamber 206*b* can function similarly as the ion transfer chamber 106 shown in FIG. 1. For example, the second ion transfer chamber 206*b* can include an ion guide 236 that generates an RF field in the ion transfer chamber 206*a*. In some cases, the ion transfer chamber 206*b* can also generate an axial electric field (i.e., an electric field extending along the direction of the path of travel of the sample ion beam). The ion transfer chamber 206*b* can also be pressurized with a gas. Sample ions exiting the quadrupole mass filter 208*a* are passed into the ion transfer chamber 206*b*, and are constrained by the RF field to oscillate about an ion guide axis 238 as they traverse the length of the ion guide 236. Collisions with the gas molecules dissipate the sample ions' kinetic energy, resulting in a reduction of their radial excursion and kinetic energies, such that, upon reaching the exit end 246 of the ion transfer chamber 206*b*, the sample ions can be focused into the entrance of a second quadrupole mass filter 208*b* with improved beam characteristics. Further, the energetic collisions with the gas molecules in the collision cell cause the precursor ions to fragment into fragment ions.

The fragment ions are then mass-resolved by the second quadrupole mass filter 208*b*, are then detected by an ion detector 210. The output signal from the ion detector 210 is processed by the control module 212, where signal intensities are recorded as a function of ion mass.

Similarly, the system 200 also includes a vacuum pumping system 242 that evacuates the various stages of the system 200. For example, the vacuum pumping system 242 can be in gaseous communication with the ion source 204, the ion transfer chambers 206*a* and 206*b*, the quadrupole mass filters 208*a* and 208*b*, and/or the ion detector 210, and can be configured to remove stray particles contained therein.

In addition to processing output signals from the ion detector, the control module 212 can also control the operation of some or all of the other components of the system 200. For example, in some cases, the control module 212 can be communicatively coupled to the ion source 204, the ion transfer chambers 206*a* and 206*b*, the quadrupole mass filters 208*a* and 208*b*, the ion detector 210, and/or the vacuum pumping system 242, and provide instructions or commands to regulate the performance of each component. In some cases, the control module 212 can be implemented, at least in part, using one or more computing devices (e.g., one or more electronic processing devices, each have one or more microprocessors, such as personal computers, smartphones, tablet computers, server computers, etc.).

Figure 3B:
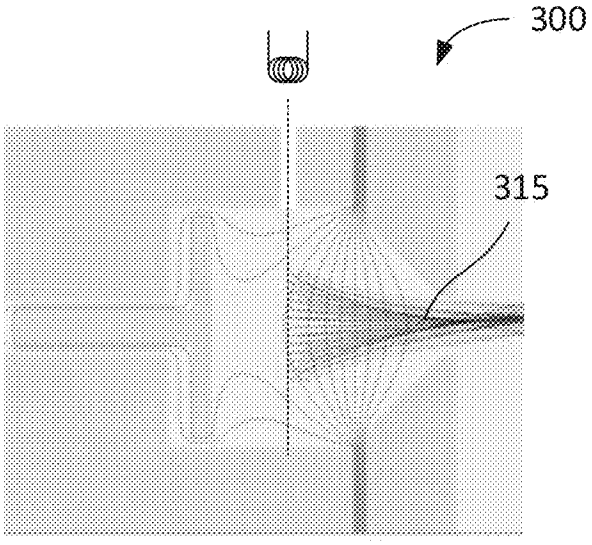
FIGS. 3A and 3B show cross-sectional views of an example ion source.
Figure 3A:
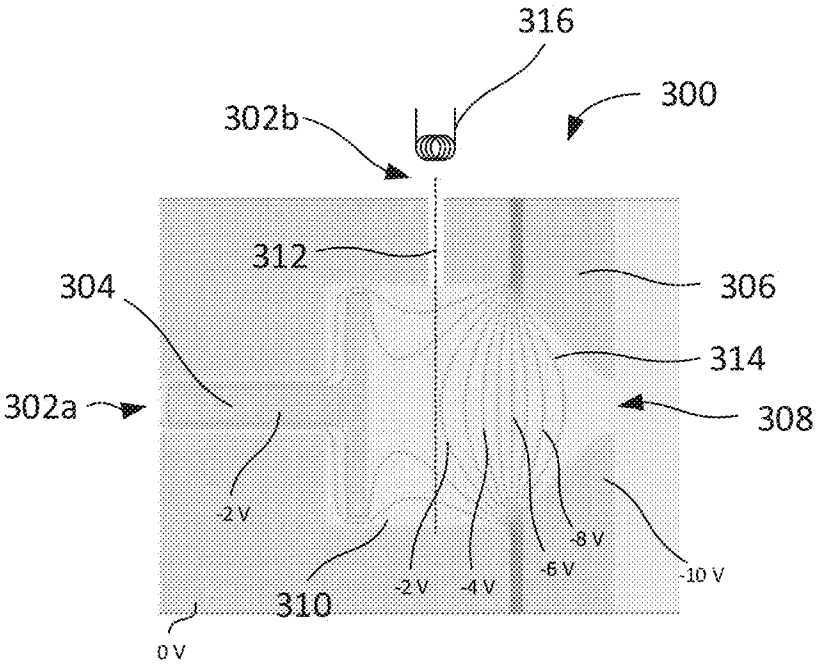

FIG. 3A shows a simplified cross-sectional view of an ion source 300. The ion source 300 can be used, for example, as the ion sources shown in FIGS. 1 and 2.

As shown in FIG. 3A, the ion source 300 includes input ports 302*a* and 302*b*, a repeller 304, an extraction electrode 306, and an extraction electrode aperture 308.

During operation of the ion source 300, the ion source 300 receives an analyte (e.g., eluted sample constituents from a GC column) through the input port 302*a*.

The ion source 300 also generates an electron beam 312 (e.g., through thermionic emission by heating a wire filament 316 with electric current running through it), and directs the electron beam 312 from the input port 302*b* into the ionization chamber 310. The electrons in electron beam 312 are accelerated from the filament 316 into ionization chamber 310 by a potential difference applied between the filament 316 and the ionization chamber 310 housing. In some cases, this potential difference can be about 70 V. In some cases, this potential difference can be adjusted to from 5 to 150 V. The electron beam 312 causes a portion of the analyte molecules to be ionized by interaction with the electrons in the electron beam 312.

Further, the ion source 300 generates an electric field within the ionization chamber 310 (illustrated in the figure by equipotential contours 314) by applying voltage(s) to an extraction electrode 306 and/or a repeller electrode 304 and/or the ion volume housing 320. The ionized analyte formed within ionization chamber 310 respond to the electric field, and are accelerated out of the ion source 300 through the extraction electrode aperture 308.

As shown in FIG. 3B, the electric field (induced by the electric potentials applied to the repeller 304 and/or the extraction electrode 306 and/or the ionization chamber housing) focus the ionized analyte and accelerate the ionized analyte out of the ion source 300 through the extraction electrode aperture 132. Simulated paths of the ionized analyte are shown as trajectories 315.

Although example applied electric potentials are described above, these are merely illustrative examples. In practice, different electric potentials can be applied to the repeller 304 and/or the extraction electrode 306 to adjust the ion beam focusing and ion acceleration properties of the ion source 300. In general, the voltage differences applied between the repeller electrode 304, the extraction electrode 306, and the ionization volume housing depend on the dimensions and shape of these electrode surfaces facing the ionization volume. In some cases, these differences may range from fractions of a volt to tens of volts. However, their actual values depend on the kinetic energy that is optimal for ions entering the downstream RF ion guide, since their kinetic energy depends on the difference between the potential at the point of ionization in the ionization volume, and the subsequent downstream ion guide DC offset voltage. On the other hand, the DC offset voltage of the RF ion guide will govern the potential of ions at the ion guide exit, the ions having been collision cooled in the ion transfer chamber. The difference between this ion guide offset voltage and a downstream mass filter will then determine the ions' kinetic energy as they are directed into the downstream mass filter. In some cases, the voltages applied to the ion source electrodes can be −50 V to +50 V.

Figure 4:
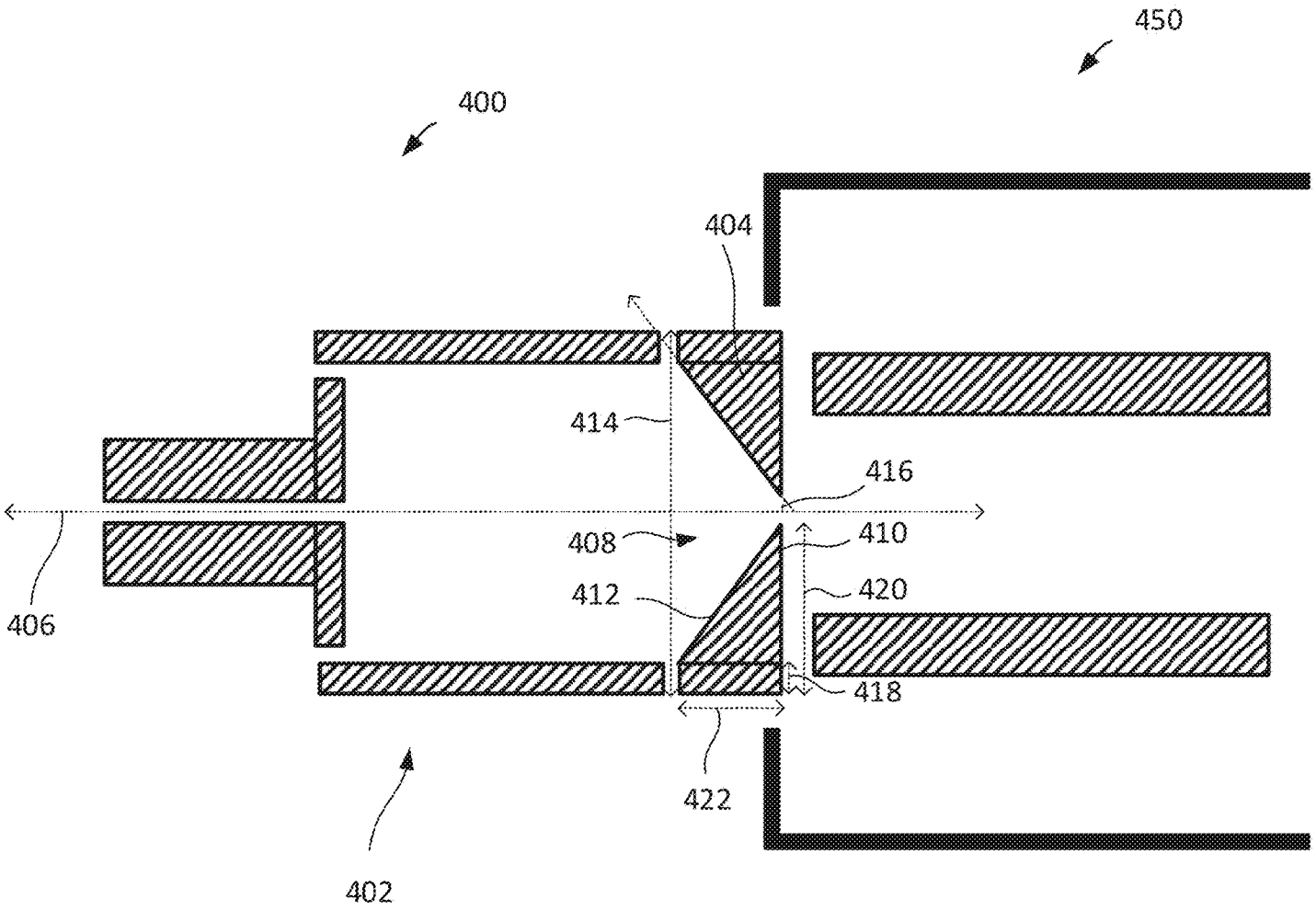
FIG. 4 shows a cross-sectional view of an example ion source and a portion of an example ion transfer chamber.

Further, the shape of the extraction electrode 306 can also differ to adjust the ion beam focusing and ion acceleration properties of the ion source 300. For example, FIG. 4 shows a simplified cross-sectional view of an example ion source 400 and a portion of an example ion transfer chamber 450. The ion source 400 and the ion chamber 450 can be used, for example, as the ion sources and ion transfer chambers shown in FIGS. 1 and 2. The ion source 400 defines an approximately cylindrical chamber 402, and an extraction electrode 404 positioned at a far end of the chamber 402. In this example, the extraction electrode 404 has a generally annular cross section along an axial extension of the chamber 402 (e.g., along the ion beam axis or central axis 406), and defines an aperture 408. Further, the cross-sectional diameter of the aperture 408 monotonically decreases from the portion of the extraction electrode 404 closest of the center of the chamber 402 to the far end 410 of the chamber 402. Thus, the inner surface 412 of the extraction electrode 404 defines a frusto-conical shape (e.g., the aperture 408 is frusto-conical).

Although an example shape for the extraction electrode 404 is shown in FIG. 4, this is merely an illustrative example. In practice, one or more dimensions of the extraction electrode 404 can be altered to adjust the ion beam focusing and ion acceleration properties of the ion source 300. For example, in some cases, the axial length 422 of the extraction electrode 404 can be between 0.5 mm and 10 mm. As another example, the diameter 414 of the extraction electrode 404 can be between 0.5 mm and 5 mm. As another example, the conical angle 416 (i.e., the angle between the central axis 406 and the inner surface 412 can be between 60 degrees and 150 degrees. As another example, the minimal annular thickness 418 can be between 0.5 mm and 2 mm. As another example, the maximum annular thickness 420 can be between 1 mm and 3 mm. In practice, other dimensions are also possible, depending on the implementation.

Figure 5:
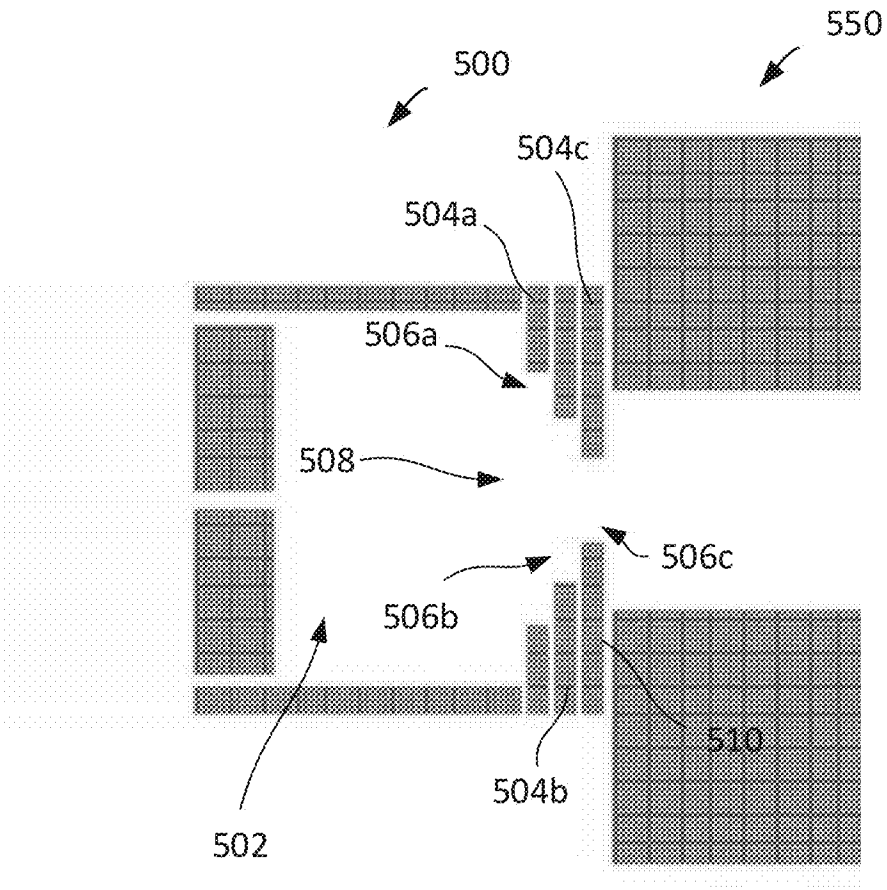
FIG. 5 shows a cross-sectional view of another example ion source and a portion of an example ion chamber.

In the example shown in FIG. 4, the ion source 400 includes a single integral extraction electrode 404. However, this need not be the case. In some implementations, an ion source can include multiple extraction electrodes that collectively define an exit aperture. For example, FIG. 5 shows a simplified cross-sectional view of another example ion source 500 and a portion of an example ion chamber 550. The ion source 500 and the ion chamber 550 can be used, for example, as the ion sources shown in FIGS. 1 and 2. As before, the ion source 500 defines an approximately cylindrical chamber 502.

However, in this example, the ion source 500 includes multiple extraction electrodes 504*a-c*. Each extraction electrode 504*a-c* in annular or disk-like in shape, each defining a respective aperture 506*a-c*. The apertures 506*a-c* are concentric, and collectively define an exit aperture 508. The cross-sectional diameter of the aperture 508 monotonically decreases from the extraction electrode 504*a* (i.e., the extraction electrode closest of the center of the chamber 502) to the extraction electrode 506*c* (i.e., the extraction electrode on the far end 510 of the chamber 502). Thus, the apertures 506-*a-c* define an approximately frusto-conical shape (e.g., a terraced frusto-conical shape).

An electric potential can be applied to each extraction electrodes 504*a-c*. In some cases, the same electrical potential can be applied to each extraction electrode 504*a-c*. In some cases, different electric potentials can be applied to some or all of the extraction electrodes 504*a-c*. For example, in some cases, voltages applied to any electrode 504*a-c* can be in the range of −100 V to +100 V.

Further, the dimensions of each of the extraction electrode 504*a-c* can be altered to adjust the ion beam focusing and ion acceleration properties of the ion source 500. For example, in some cases, the axial length of each extraction electrode 504*a-c* can be between 0.5 mm to 3.0 mm. As another example, the diameter of each extraction electrode 504*a-c* can be between 1 mm and 10 mm. As another example, the inner diameter of each extraction electrode 504*a-c* can be between 0.5 mm and 5.0 mm. As another example, the minimal annular thickness (e.g., the annular thickness of the center-most extraction electrode 504*a*) can be between 0.5 mm and 5.0 mm. As another example, the maximum annular thickness (e.g., the annular thickness of the extraction electrode 504*c* closest to the end 510) can be between 0.5 mm and 5.0 mm. In practice, other dimensions are also possible, depending on the implementation.

Further, although three extraction electrode 504*a-c* as shown in FIG. 5, this is also merely an illustrative example. In practice, an ion source can include any number of extraction electrodes (e.g., one, two, three, four, five, or more). Similarly, the electric potential applied to each extraction electrode and the dimensions of each extraction electrode can differ to give the ion source different ion beam focusing and ion acceleration properties.

In some cases, an ion source can include a magnetic field generator configured to generate a magnetic field in a direction parallel to a direction of the electron beam and coincident with the electron beam. This can be useful, for example, as it can cause the electrons of the electron beam to travel in a helical direction about the direction of the electron beam, thereby lengthening the path of each electron within the ion chamber, and increasing the likelihood that each electron will interact with and ionize the analyte.

Figure 6:
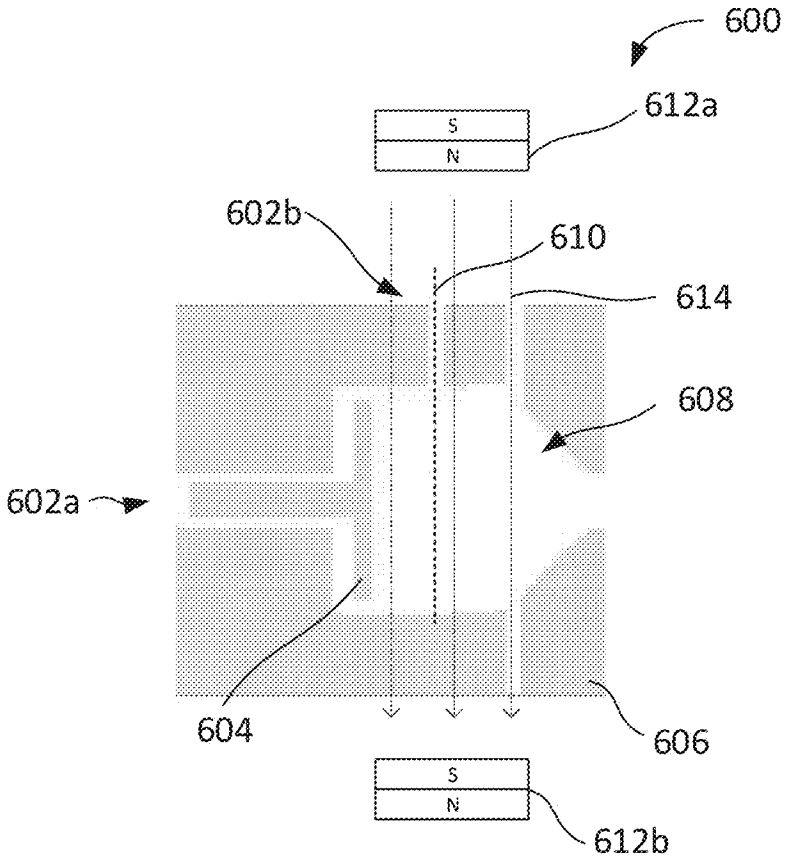
FIG. 6 shows a cross-sectional view of an example ion source.

As an example, FIG. 6 shows a simplified cross-sectional view of an ion source 600. The ion source 600 can be used, for example, as the ion sources shown in FIGS. 1 and 2.

As shown in FIG. 6, the ion source 600 includes input ports 602*a* and 602*b*, a repeller 604, and an extraction electrode 606.

During operation of the ion source 300, the ion source 600 receives an analyte (e.g., eluted sample constituents from a GC column) through the input port 602*a*. The analyte is propelled into the ionization chamber 608 by the repeller 604.

The ion source 300 also generates an electron beam 610 (e.g., by heating a wire filament with electric current running through it), and directs the electron beam 610 from the input port 602*b* into the ionization chamber 608. The ion source also includes two permanent magnets 612*a* and 612*b* positioned on opposite ends of the electron beam 610, and aligned in the direction parallel to the direction of the electron beam. This generates a magnetic field in the ion chamber 612 (represented by magnetic field vectors 614).

Figure 7:
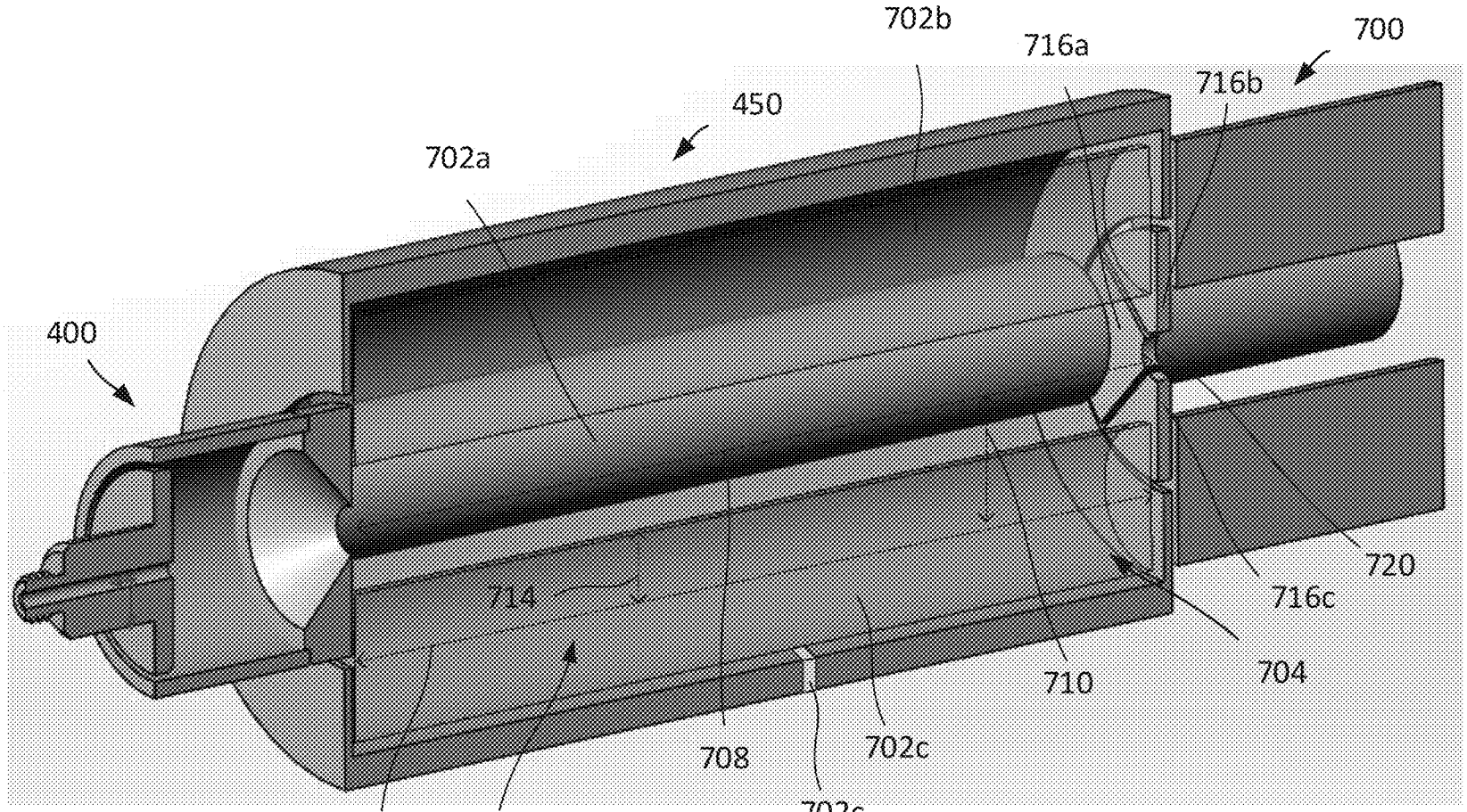
FIG. 7 shows cross-sectional view of the example ion source and the example ion transfer chamber shown in FIG. 4, and a portion of an example quadrupole mass filter.

FIG. 7 shows a simplified cross-sectional view of the example ion source 400 and the example ion transfer chamber 450 shown in FIG. 4, and a portion of an example quadrupole mass filter 700. The ion source 400, the ion transfer chamber 450, and the quadrupole mass filter 700 can be used, for example, as the ion sources, ion transfer chambers, and quadrupole mass filters shown in FIGS. 1 and 2. As shown in FIG. 7, the ion chamber 450 defines an approximately cylindrical inner chamber 702. The ion chamber 450 also includes an ion guide 704 that extends along the length of the inner chamber 702. In the example shown in FIG. 7, the ion guide 704 includes four parallel electrically conductive rods 706*a-d* arranged in a 2×2 configuration surrounding an ion guide axis 708, where each opposing rod pair (e.g., 706*a* and 706*d*, and 706*b* and 706*c*) is connected together electrically. Due to the cross-sectional view depicted in FIG. 7, rods 706*b* and 706*c* are shown in cross-section, and rod 706*d* is not shown. An RF voltage is applied between each rod pair to generate a RF field in the inner chamber 702. Sample ions exiting the ion source 400 are passed into the inner chamber 702 of the ion transfer chamber 450, and are constrained by the RF field to oscillate about the ion guide axis 708 as they traverse the length of the inner chamber 702 and the ion guide 704. The ion guide 704 RF field induces a radial pseudo-potential well along the ion guide axis 708.

The electrically conductive rods 706*a-d* are each equidistant from the ion guide axis 708, and are radially distributed about the ion guide axis 708 (e.g., positioned with 90° angular distance between them with respect to the ion guide axis 708). The distance between each conductive rod 706*a-d* and the ion guide axis 708 can vary. For example, the radial distance 710 between ion guide axis 708 to a center of a conductive rod can be between 1 mm and 10 mm.

The dimensions of the conductive rods 706*a-d* can also vary. For example, the length 712 of each conductive rod 706*a-d* can be between 10 mm and 200 mm. As another example, the diameter 714 of each conductive rod 706*a-d* can be between 1 mm and 10 mm.

In practice, other dimensions are also possible, depending on the implementation. The RF voltage applied to each opposing rod pair can also vary. For example, in some cases, a voltage between 10 V to beyond 1000 V RF can be used.

In some cases, the ion guide 704 can also include additional electrodes positioned either of the axial ends of the ion transfer chamber 450. For example, as shown in FIG. 7, the ion guide 704 includes four additional electrodes electrically conductive electrodes 716*a-d* arranged surrounding an ion guide axis 708, where each opposing rod pair (e.g., 716*a* and 716*d*, and 716*b* and 716*c*) is connected together electrically. Due to the cross-sectional view depicted in FIG. 7, electrodes 716*b* and 716*c* are shown in cross-section, and electrode 716*d* is not shown. In some cases, the each of the electrodes can be axially aligned with, and electrically connected to, a corresponding conductive rod. For example, the electrode 716*a* can be axially aligned with and electrically connected to the rod 702*a*, the electrode 716*b* can be axially aligned with and electrically connected to the rod 702*b*, the electrode 716*c* can be axially aligned with and electrically connected to the rod 702*c*, and the electrode 716*d* can be axially aligned with and electrically connected to the rod 702*d*. This can be beneficial, for example, as it enables the ion guide 704 to generate a more consistent RF field within the inner chamber 702, thereby improving the focusing characteristics performance of the ion transfer chamber 450.

In some cases, ion transfer chamber 450 can also generate an axial electric field (i.e., an electric field extending along the direction of the path of travel of the sample ion beam along the ion guide axis 708) that further forces the sample ions axially through the ion transfer chamber 450. This can be useful, for example, in ensuring such that the collisions within the ion transfer chamber 450 do not significantly delay the transport of ions through the ion transfer chamber 450 and into the quadrupole mass filter.

In some cases, the ion transfer chamber 450 can also be pressurized with a gas. For example, as shown in FIG. 7, the ion transfer chamber 450 can include a gas manifold 718 (e.g., an input port or aperture) for receiving gas from a gas source (e.g., a gas tank), such that the inner chamber 702 is pressurized. The gas pressure can vary in the inner chamber 702. For example, the gas pressure within the inner chamber 702 can be approximately 1 mTorr to 100 mTorr. Various gases can be used to pressurize the inner chamber 702, such as, nitrogen, argon, helium, etc.

As described above, collisions between the sample ions and the gas molecules dissipate the sample ions' kinetic energy, resulting in a reduction of the sample ions' radial excursion and kinetic energies. Thus, upon reaching the exit end 720 of the ion transfer chamber 450, the sample ions can be focused into the entrance of the quadrupole mass filter 700 with improved beam characteristics.

Figure 8:
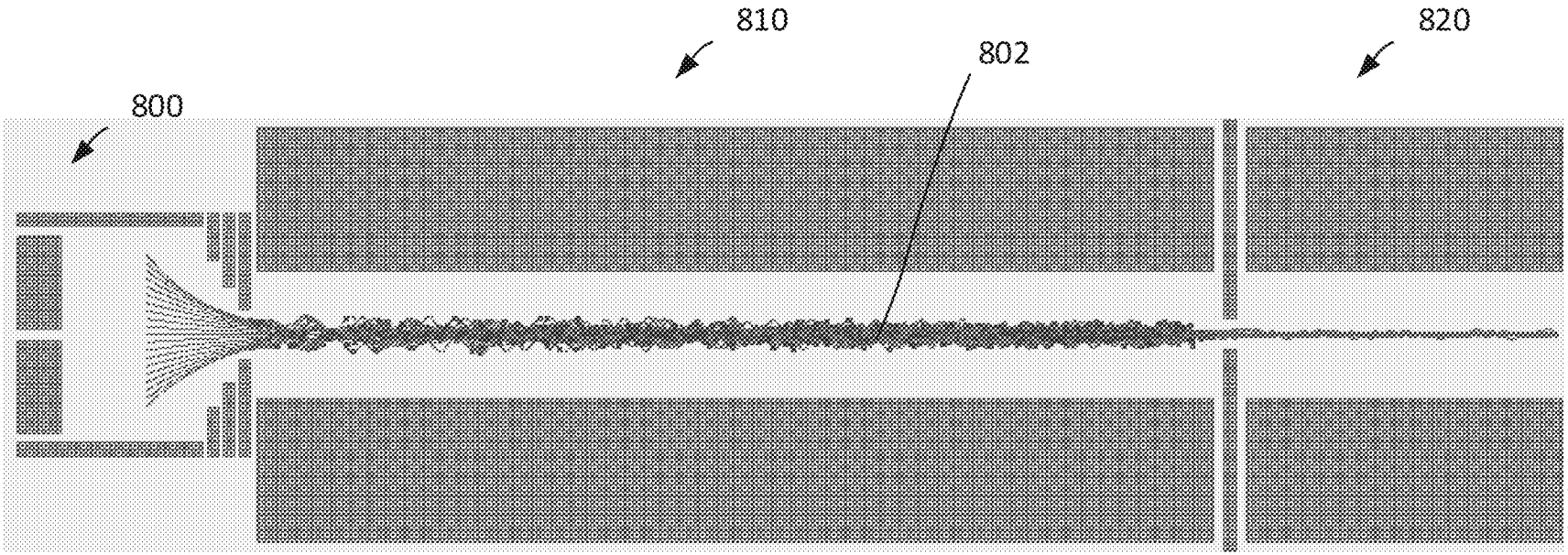
FIG. 8 shows a cross-sectional view of an example ion source, an example ion transfer chamber, and an example quadrupole mass filter.

As an example, FIG. 8 shows a simplified cross-sectional view of the example ion source 800, an example ion transfer chamber 810, and an example quadrupole mass filter 820. The ion source 800, the ion transfer chamber 810, and the quadrupole mass filter 820 can be used, for example, as the ion sources, ion transfer chambers, and quadrupole mass filters shown in FIGS. 1 and 2. Simulated paths of the ionized analyte are shown as paths 802. As shown in FIG. 8, the ion source 800 receives an analyte (e.g., eluted sample constituents from a GC column) and ionizes the received particles. The ionized analyte is focused within the ion source 800, and accelerated into the ion transfer chamber 810. The ion transfer chamber 810 further focuses the ionized analyte, and reduces the kinetic energy of the ionized analyte (due to the collisions for the gas pressurized within the ion transfer chamber 810). The ionized analyte is subsequently injected in the mass filter 820 for further processing.

In some cases, gas molecules can be directionally injected into the ion transfer chamber, such that a directional flow of gas is induced within the ion transfer chamber. This can be beneficial, for example, as it can reduce the sample ions' radial excursion and kinetic energies more rapidly than without such directed gas flow, as well as facilitate the continuous movement of ions along the axis as the ions experience collision cooling along the way, with or without the presence of an axial electric field. As an example, the gas molecules can be injected such that a flow of gas extends along an axis of extension of the ion transfer chamber, in the direction from the entrance of the ion transfer chamber to the exit of the ion transfer chamber.

Figure 9:
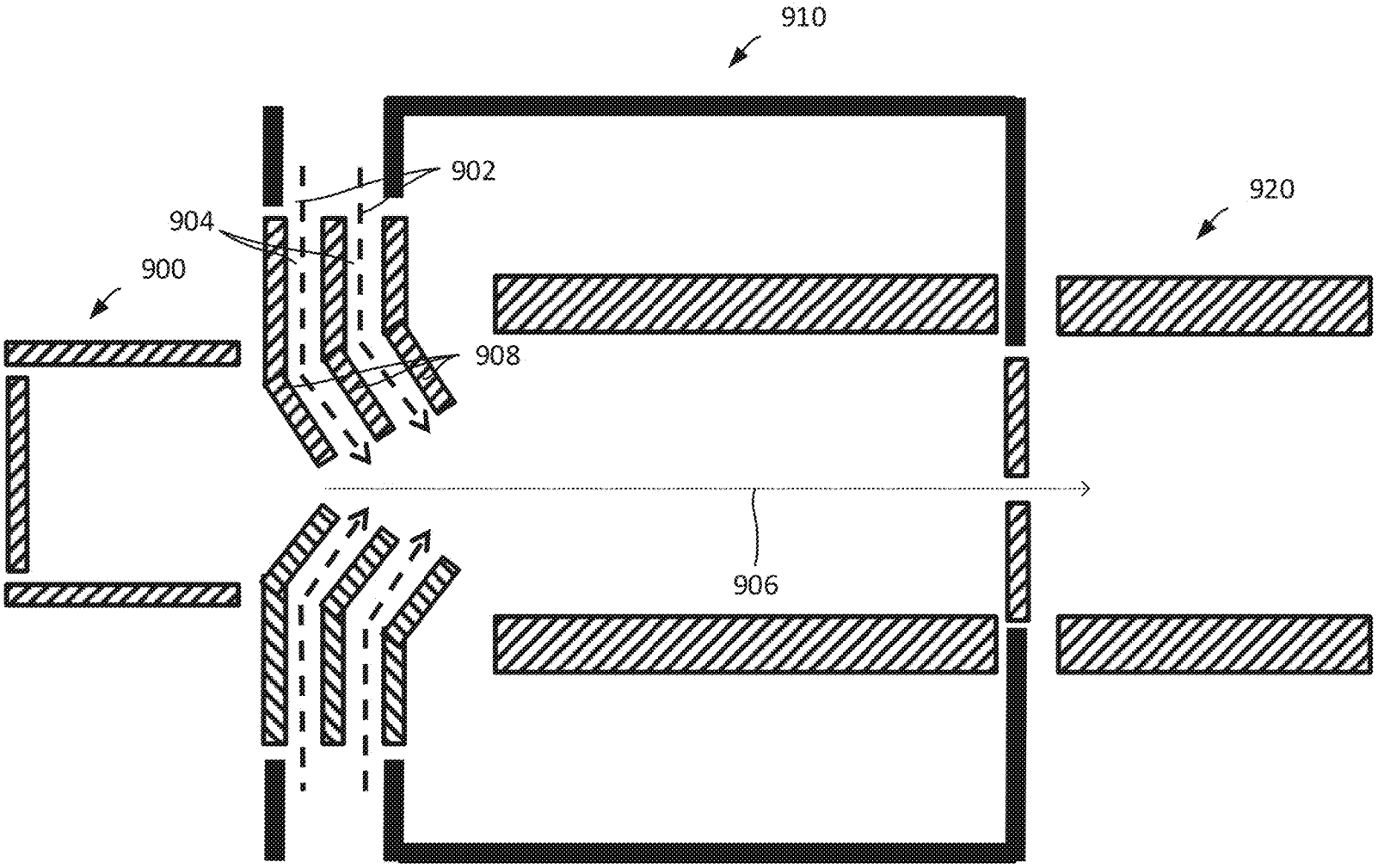
FIG. 9 shows a cross-sectional view of another example ion source, another example ion transfer chamber, and another example quadrupole mass filter.

As an example, FIG. 9 shows a simplified cross-sectional view of the example ion source 900, an example ion transfer chamber 910, and an example quadrupole mass filter 920. The ion source 900, the ion transfer chamber 910, and the quadrupole mass filter 920 can be used, for example, as the ion sources, ion transfer chambers, and quadrupole mass filters shown in FIGS. 1 and 2. As shown in FIG. 9, gas molecules (represented by dotted line 902) are directionally injected into the ion transfer chamber 910 (e.g., via gas ducts or conduits 904). The gas molecules flow across the ion transfer chamber 910 (e.g., in an axial direction along the axis of extension 906 of the ion transfer chamber 910), forming a directional gas jet. This gas jet propels the sample ions through the ion transfer chamber 910.

In some cases, the gas molecules can be directionally injected into the ion transfer chamber, such that the resulting gas jet imparts both an axial force and a radial force (e.g., orthogonal to the axial force) on the sample ions. For example, as shown in FIG. 9, the ion transfer chamber can include focusing or funneling structures 908 (e.g., baffles or flanges), that radially focus the gas molecules into a narrow stream. This can be useful, for example, to further compact the sample ions, and to further reduce the sample ions' radial excursion.

A number of embodiments have been described. Nevertheless, it will be understood that various modifications may be made without departing from the spirit and scope of the invention. Accordingly, other embodiments are within the scope of the claims.

What is claimed is:

1. A system comprising:

an ion source including:

an electron source configured, during operation of the system, to generate a flow of electrons;

a sample introduction assembly configured, during operation of the system, to transport at least one analyte;

an ionization chamber having a first input port, a second input port, and an outlet port; and an electrode assembly;

a collision cooling chamber; and a mass analyzer, wherein the first input port is configured, during operation of the system, to receive the flow of electrons from the electron source;

wherein the second input port is configured, during operation of the system, to receive the at least one analyte from the sample introduction assembly, whereby analyte ions are created by interaction between the at least one analyte and the electrons within an ionization region of the ionization chamber, and whereby the analyte ions exit the ionization chamber through the outlet port along an ion beam axis;

wherein the ionization chamber comprises a chamber electrode configured, during operation of the system, to have a first voltage applied thereto, wherein the entrance electrode assembly defines the outlet port of the ion source, the electrode assembly being integrated into the ion source as a part, wherein the electrode assembly is configured, during operation of the system, to have an electrode voltage applied thereto and to collect and receive analyte ions from the ion source, wherein the electrode assembly comprises an upstream surface facing the ionization region, the upstream surface defining a substantially frusto-conical shape having a smaller base and a larger base, the smaller base being proximal to or coincident with the outlet port, wherein, during operation of the system, electric fields within the ionization chamber resulting from the voltages applied to the electrode assembly and at least one other electrode act to focus and accelerate the analyte ions from the ionization region through the outlet port and into the collision cooling chamber.

2. The system of claim 1, wherein the substantially frusto-conical shape is formed by at least two disks butted face to face, wherein the at least two disks have apertures that are concentric with respect to the ion beam axis, wherein the sizes of the apertures monotonically decrease, respectively, from the disk closest to the ionization region to the disk farthest from the ionization region.

3. The system of claim 1, wherein the electron beam generator is configured, during operation of the system, to generate the electron beam in a first transverse direction within the ionization chamber, the first transverse direction being orthogonal to the ion beam axis, and wherein the ion source chamber comprises a magnetic field generator configured, during operation of the system, to generate a magnetic field in a direction parallel to a direction of the electron beam and coincident with the electron beam.

4. The system of claim 3, wherein the magnetic field generator comprises at least two permanent magnets.

5. The system of claim 4, wherein the at least two permanent magnets are aligned in the direction parallel to the direction of the electron beam.

6. The system of claim 1, wherein the chamber electrode and the electrode assembly are configured to generate the electric fields to spatially focus the sample ions through said ion exit outlet port.

7. The system of claim 1, wherein the mass analyzer comprises at least one of:

a quadrupole mass filter;

a combination of two quadrupole mass filters separated by a collision chamber, a combination of a quadrupole mass filter, a collision chamber, and a time-of-flight mass analyzer;

a time-of-flight mass analyzer;

a three-dimensional ion trap; or a two-dimensional ion trap.

8. The system of claim 1, wherein the sample introduction assembly comprises an exit portion of a gas chromatography column.

9. A system comprising:

an electron ionization ion source comprising an electrode assembly, the electron ionization ion source being configured, during operation of the system, to create from sample molecules a beam of ions extending along an ion beam axis;

a collision cooling chamber comprising a gas manifold, an electric field generator, and a mass analyzer, wherein the collision cooling chamber defines an entrance aperture and an exit aperture on respective opposing ends of the cooling chamber, the entrance aperture of the cooling chamber being in axial alignment with the ion beam axis, wherein the electrode assembly is configured, during operation of the system, to collect and receive ions from the electron ionization ion source, and wherein the electrode assembly is integrated into the electron ionization ion source as a part, wherein the cooling chamber is configured, during operation of the system, to:

generate a radio frequency (RF) field within the collision cooling chamber using the electric field generator, and receive collision gas through the gas manifold to pressurize the collision cooling chamber.

10. The system of claim 9, wherein the electric field generator is further configured, during operation of the system, to generate an axial electric field extending along at least a portion of a length of the collision cooling chamber.

11. The system of claim 9, wherein the collision cooling chamber is configured, during operation of the system, to be pressurized with collision gas at a pressure between 1 mTorr and 100 mTorr.

12. The system of claim 9, wherein the cooling chamber is configured, during operation of the system, to:

receive ions from the electron ionization ion source through the entrance aperture;

reduce a kinetic energy of at least some of the received ions; and expel at least some of the received ions out of the collision cooling chamber through a second exit aperture.

13. The system of claim 12, wherein reducing a kinetic energy of at least some of the received ions comprises inducing one or more collisions between the received ions and molecules of the collision gas.

14. The system of claim 9, wherein the electric field generator comprises a plurality of conductive rods extending along at least a portion of the length of the collision cooling chamber, wherein the rods are arranged axisymmetrically within the cooling chamber.

15. The system of claim 9, wherein the collision cooling chamber exit aperture comprises a plurality of exit aperture electrodes arranged axisymetrically about a collision cooling chamber exit axis, wherein the plurality of exit aperture electrodes are configured, during operation of the system, to have RF and DC offset voltages applied thereto.

16. The system of claim 9, wherein the mass analyzer is configured, during operation of the system, to receive ions from the collision cooling chamber for mass analysis.

17. The system of claim 16, wherein the mass analyzer comprises at least one of:

a quadrupole mass filter;

a combination of two quadrupole mass filters separated by a collision chamber;

a combination of a quadrupole mass filter, collision chamber, and a time-of-flight mass analyzer;

a time-of-flight mass analyzer;

a three-dimensional ion trap; or a two-dimensional ion trap.

18. The system of claim 16, further comprising a gas chromatograph, wherein the electron ionization ion source is configured, during operation of the system, to receive sample effluent from the gas chromatograph.

19. A system comprising:

an ion source chamber comprising:

a first input port;

a second input port; and a first exit port; and a electrode assembly proximate to the first exit port of the ion source chamber, the entrance electrode assembly being integrated into the ion source chamber as a part; and a collision cooling chamber wherein the system is configured, during operation, to:

receive an analyte through the first input port, receive a flow of electrons through the second input port, generate analyte ions in an ionization region within the ion source chamber through an interaction between the analyte and the electrons, collect and receive ions, using the electrode assembly, the analyte ions from the ion source chamber, and focus and accelerate the analyte ions, using the electrode assembly, from the ion source chamber through the exit port along an ion beam axis and into the collision cooling chamber, and wherein the electrode assembly defines an electrode aperture along the ion beam axis, and wherein the electrode aperture has a cross-section area that monotonically decreases in a direction from the ionization region to the first exit port along the ion beam axis.

20. The system of claim 19, the cooling chamber further comprising:

a gas manifold, an electric field generator, a third input port on a first end of the collision cooling chamber, wherein the third input port is in axial alignment with the ion beam axis, a second exit port on a second end of the collision cooling chamber, wherein the collision cooling chamber is configured, during operation of the system, to:

generate a radio frequency (RF) field within the collision cooling chamber using the electric field generator, and receive collision gas through the gas manifold to pressurize the collision cooling chamber.

21. A system comprising:

1) an ion source comprising a first electrode assembly, the ion source being configured, during operation of the system, to turn sample molecules into a plurality of ions and deliver the plurality of ions out of the ionization volume through an ion source exit outlet port;

2) a collision cooling chamber comprising a gas manifold, a gas flow guide, at least one RF-only ion guide, a second electrode assembly configured to generate an axial electric field, and a third electrode assembly;

3) a mass analyzer, wherein the entrance electrode assembly is configured, during operation of the system, to collect and receive the plurality of ions from the ion source, and wherein the entrance electrode assembly is integrated into the ion source as a part.

22. The system of claim 21, wherein the ion source comprises at least one of:

an Electron Impact (EI) ionization source; or a Chemical Ionization (CI) source.

23. The system of claim 21, wherein the second electrode assembly is configured, during operation of the system, to generate the axial electric field such that the axial electric field extends along at least a portion of the length of the collision cooling chamber.

24. The system of claim 21, wherein the collision cooling chamber is configured, during operation of the system, to be pressurized with collision gas via the gas manifold.

25. The system of claim 21, wherein the gas flow guide is positioned at an entrance of the collision cooling chamber and configured, during operation of the system, to form a conical conduit concentric with an entrance aperture of the collision cooling chamber, wherein a gas flow through the conical conduit concentrates the plurality of ions radially and moves the plurality of ions toward the mass analyzer.

26. The system of claim 21, wherein the RF-only ion guide(s) comprise(s) a plurality of conductive columnar electrodes extending along at least a portion of a length of the collision cooling chamber and being arranged axisymmetrically within the collision cooling chamber.

27. The system of claim 21, wherein the third electrode assembly is configured, during operation of the system, to expel at least some of the plurality of ions out of the collision cooling chamber, and wherein the third electrode assembly is further azimuthally divided into at least four subunits having RF and DC offset voltages applied thereto.

28. The system of claim 21, wherein the mass analyzer is configured, during operation of the system, to receive the plurality of ions from the collision cooling chamber for mass analysis.

29. The system of claim 28, wherein the mass analyzer comprises at least one of:

a quadrupole mass filter;

a combination of two quadrupole mass filters separated by a collision chamber;

a combination of a quadrupole mass filter, collision chamber, and a time-of-flight mass analyzer;

a time-of-flight mass analyzer;

a three-dimensional ion trap; or a two-dimensional ion trap.

* * * * *